United States Patent [19]

Raymer et al.

[11] Patent Number: 4,600,148

[45] Date of Patent: Jul. 15, 1986

[54] DRAINLESS WATER COOLER

[75] Inventors: Doyle Raymer; Michael Eveland, both of Freeport, Ill.; Dennis J. Heyden, Browntown, Wis.

[73] Assignee: King-Seeley Thermos Co., Prospect Heights, Ill.

[21] Appl. No.: 542,437

[22] Filed: Oct. 17, 1983

[51] Int. Cl.[4] ..... B05B 12/14

[52] U.S. Cl. ..... 239/29.3; 4/632

[58] Field of Search ..... 239/16, 29, 29.3, 28; 62/391, 390, 394, 396; 4/632; 165/48 R, 61

[56] References Cited

U.S. PATENT DOCUMENTS

| | | | |
|---|---|---|---|
| D. 190,063 | 4/1961 | Benua | D67/4 |
| D. 191,771 | 11/1961 | Benua | D67/4 |
| D. 228,685 | 10/1973 | Radcliffe | D23/1 |
| D. 235,388 | 6/1975 | Taylor | D15/8 |
| 1,586,745 | 6/1926 | Hulse | 62/389 |
| 1,763,808 | 6/1930 | Muffly | 62/389 |
| 1,772,111 | 8/1930 | Rice | 62/389 |
| 1,825,665 | 10/1931 | Hull | 62/393 |
| 1,912,572 | 6/1933 | Ebinger | 62/389 |
| 2,001,341 | 5/1935 | Clarke | 299/9 |
| 2,112,379 | 3/1938 | Pesch | 62/391 X |
| 2,397,690 | 4/1946 | Pawlus et al. | 4/632 X |
| 2,459,774 | 1/1949 | Morrison | 62/391 |
| 2,512,961 | 6/1950 | Morrison | 62/141 |
| 2,529,781 | 11/1950 | Morrison | 62/7 |
| 2,554,417 | 5/1951 | Morrison | 62/141 |
| 2,581,125 | 1/1952 | Morrison | 62/141 |
| 2,650,800 | 9/1953 | Taylor | 257/180 |
| 2,750,756 | 6/1956 | Canter | 62/4 |
| 2,767,960 | 10/1956 | Fast | 165/61 X |
| 2,920,463 | 1/1960 | Gould | 62/390 |
| 3,033,007 | 5/1962 | Lyman | 62/298 |
| 3,055,810 | 9/1962 | Skow | 202/71 |
| 3,060,703 | 10/1962 | Benua et al. | 62/394 |
| 3,179,292 | 4/1965 | Terry | 222/52 |
| 3,269,143 | 8/1966 | Gasparovich | 62/389 |
| 3,333,438 | 8/1967 | Benua et al. | 62/395 |
| 3,333,741 | 8/1967 | Radcliffe | 222/189 |
| 3,363,432 | 1/1968 | Sholtes | 62/397 |
| 3,554,446 | 1/1971 | Castillo | 239/24 |
| 3,698,603 | 10/1972 | Radcliffe | 222/146 R |
| 3,811,294 | 5/1974 | Taylor | 62/390 |
| 3,943,727 | 3/1976 | Wade | 62/395 |
| 4,061,184 | 12/1977 | Radcliffe | 222/146 R |

*Primary Examiner*—William E. Tapolcai

*Attorney, Agent, or Firm*—Harness, Dickey & Pierce

[57] ABSTRACT

A drainless water cooler or fountain having a gooseneck water dispensing faucet and a waste water receptacle cup mounted on top of the multiply tiered top member. A cup is removably carried within a downwardly depending well which can be retrofitted for readily and economically converting the drainless-type water fountain or cooler into a more permanent drain connected installation. A dual action valve featuring reduced diameter valve seat and valve construction is capable of regulating and dispensing either hot or cold water through the common gooseneck faucet. Placement of the faucet and waste water receptacle cup on the top of the cabinet eliminates the need to bend or stoop when dispensing water or emptying the receptacle cup. The receptacle cup is disposed within the interior of the cabinet and is thus protected against accidental bumping or spilling.

7 Claims, 7 Drawing Figures

DRAINLESS WATER COOLER

BACKGROUND OF THE INVENTION

1. Field of the Invention

This invention pertains generally to drainless water coolers and drinking fountains, and more particularly to a free standing water cooler or fountain that does not require connection to a waste water removal system or drain, but which may be readily retrofitted with plumbing for connection to a waste water removal system. The invention further pertains to a drainless water cooler or fountain for dispensing either conditioned or unconditioned water from a pressurized potable water source in which the faucet and drip catch basin are located on the top of the cabinet so the consumer need not bend over or stoop when drawing water or emptying the catch basin.

2. Description of the Prior Art

In applications where waste water removal plumbing is not readily available, drainless water coolers have proven to be a popular means of providing drinking water. As the name implies, drainless water coolers have no drain or means for connection to a waste water removal plumbing system. Instead of a drain, drainless water coolers are equipped with a catch basin or a waste water receptacle for catching the occasional drips and spills. Although the catch basin must be frequently emptied, the drainless feature has been considered desirable since it allows water coolers to be placed in open offices, shops and stores where waste water removal plumbing is unavailable or where the expense of installing such plumbing is not justified by the number of persons who will be using the water cooler. However, as an office, shop or store grows in size, the demand for drinking water will often times increase beyond the intended capacity of the drainless water cooler. Routine emptying of the waste water receptacle may become so frequent as to be impractical. In response to such growth the only solution heretofore available was to retire the drainless water cooler in favor of a more permanent water cooler or a fountain connected to a waste water removal system. The changeover costs of replacing the drainless water cooler with a more permanent drain connected water cooler are appreciable, since the initial investment in the drainless water cooler is lost.

Aside from the inability of prior art drainless water coolers to accommodate growth in water consumption, prior art drainless water coolers suffer from a number of other problems. Generally, the drainless water coolers of the prior art may be grouped into two categories, those which include a self-contained supply of potable water, i.e. bottled water, and hence require no external plumbing, and those which are intended to be coupled to a pressurized source of potable water by means of external plumbing (but nevertheless lack bulkier drain plumbing). Such prior art devices, whether equipped with self-contained water supply or coupled to a pressurized source, are commonly housed in an upright cabinet having a dispensing faucet mounted on the front panel thereof and having a catch basin or waste water receptacle mounted on the front panel beneath the water dispensing faucet. With faucet and catch basin in this location, the average sized consumer must bend or stoop to dispense water from the faucets, and must also bend to remove the catch basin for emptying or cleaning. Quite often, too, the catch basin of the prior art water cooler is cantilevered to the front panel so that passersby may accidentally bump into it and knock it off, usually spilling the waste water in the process.

Another problem with prior art drainless water coolers employing pressurized water sources is with spillage of water from the reservoir. Typically, water is stored within a vented reservoir that depends on a float means similar to that found in water closets to control the level of filling. When sediment or other foreign material builds up on the pivotal connection of this type of float valve, closure is not always achieved and water seeps constantly through the valve and overflows from the reservoir. Furthermore, the entire water supply system of prior art drainless water coolers (including bottled water coolers) is vented to the atmosphere and bacterial contamination and fungus growth will result in unsanitary conditions for the consumer unless frequently cleaned. Also, when both heating and chilling are included the prior art drainless water fountain provides separate hot and cold faucets. Separate faucets are considered less aesthetically pleasing and could increase production costs, unless quality is compromised.

Accordingly, it is an object of the present invention to improve upon the drainless water coolers of the prior art by providing a drainless water cooler which may be easily retrofitted with drain plumbing so that the unit need not be discarded when increased demand for water dictates that a more permanent drain connected system be installed. Another object is to provide a drainless water cooler which eliminates the need for bending or stooping when filling a cup with water or when emptying or cleaning the waste water receptacle. Yet another object is to provide a drainless water cooler with improved valve construction to permit the water cooler to be connected to sources of potable water at line pressure without leaking, dripping or overflowing and which will permit dispensing of heated or chilled water through a common faucet. And yet another object is to provide an entire unvented water supply system that maintains sanitary conditions without cleaning. These and other objects and advantages of the invention will become more apparent from a reading of the following specification and reference to the accompanying drawings.

SUMMARY OF THE INVENTION

According to the present invention the drainless water dispenser coupled to a pressurized source of potable water is provided. The invention comprises a generally upright cabinet having a top member disposed thereon. A goose-neck water dispensing faucet is disposed on the top member of the cabinet for coupling to the water supply, and a waste water receptacle is conveniently disposed in a well formed in the top member so as to catch the occasional drips or splashes therein. The waste water receptacle includes a grate in the open end thereof which is generally flush with the surface of the top member when the waste water receptacle is in place within the interior of the cabinet and the well includes a convenient bottom area that can be punched out for installation of a drain fitting which enables the drainless water dispenser to be retrofitted with waste water removal plumbing should the user wish to make the installation more permanent. The location of the faucet on top of the cabinet eliminates bending or stooping and the waste water receptacle, also located on the top of the cabinet, is likewise easily removable without bending or stooping. The faucet of the present invention also includes a dual action valve which enables both hot and cold water to be dispensed from a common faucet.

BRIEF DESCRIPTION OF THE DRAWINGS

FIG. 5 is a detailed view of the dual action valve of the invention;

DESCRIPTION OF THE PREFERRED EMBODIMENTS

Figure 1:
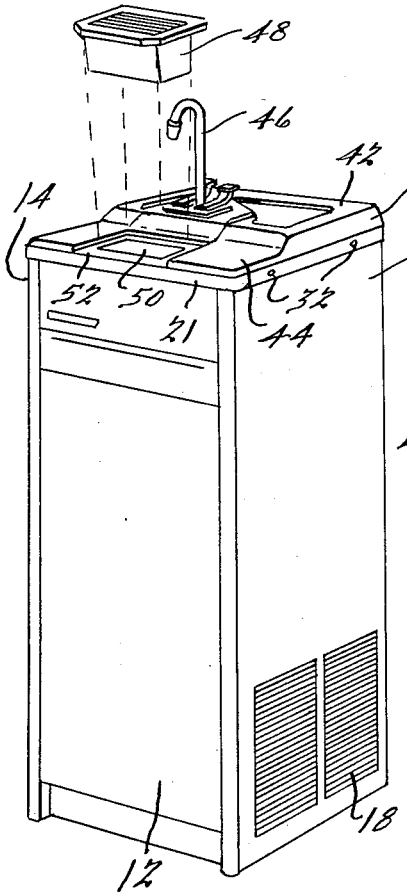
FIG. 1 is a perspective view of the invention illustrating removal of the waste water receptacle.

Referring first to FIG. 1, the invention comprises a generally upright cabinet 10 having a removable front panel 12 and removable left and right side panels 14 and 16 respectively. Side panels 14 and 16 include vents or louvers 18 to permit adequate air circulation within the interior of the cabinet for heat dissipation. Panels 12, 14 and 16 are preferably constructed of either painted sheet steel, stainless steel (or other non-corrosive material), or sheet metal with decorative plastic material laminated or bonded to the exterior surfaces. The invention further comprises a top member 20, also shown in FIGS. 6 and 7, which may be molded from a thermoplastic material, or fabricated from a metallic material and finished with a protective coating, or otherwise fabricated from a noncorrosive material.

Figure 2:
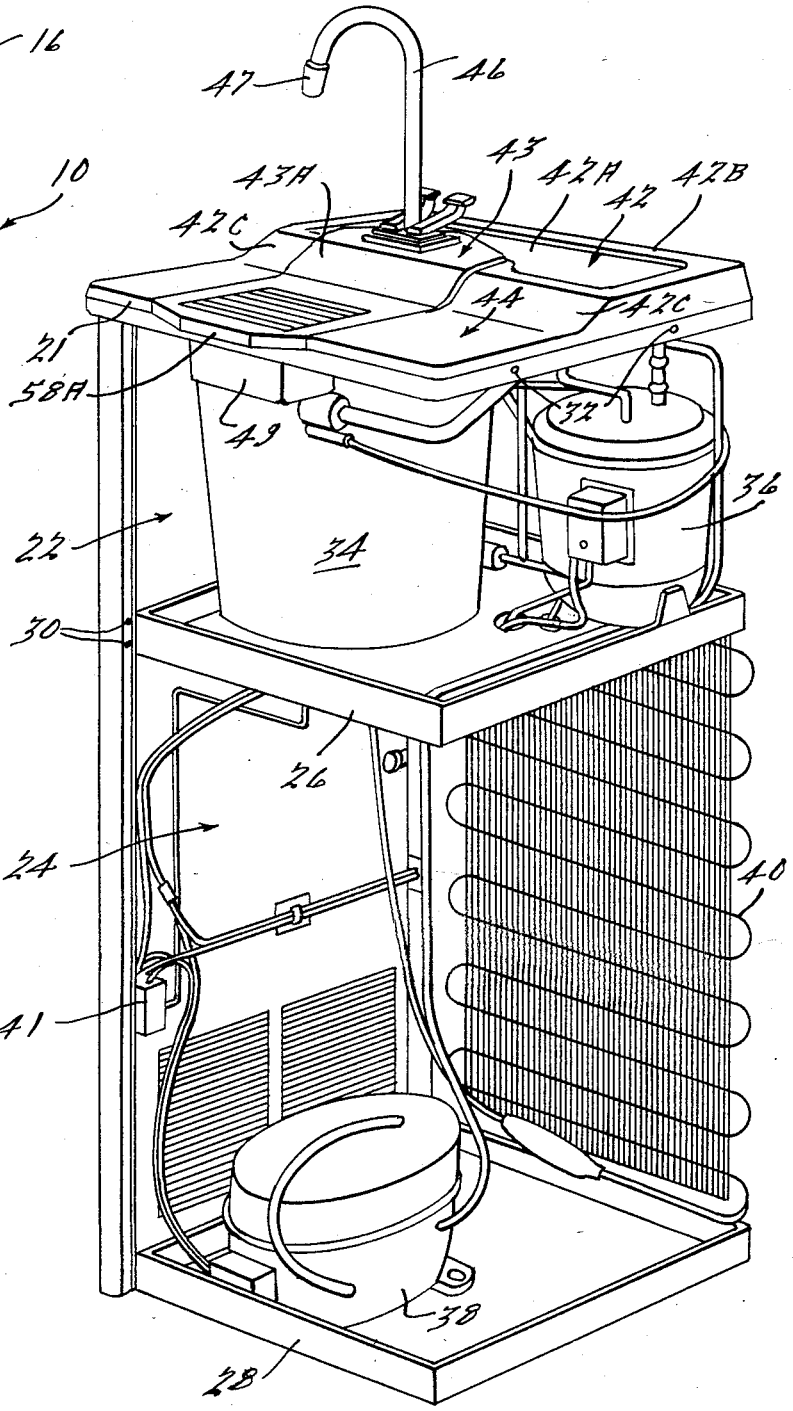
FIG. 2 is a similar view with front and side panel removed to reveal the interior of the cabinet.

With reference to FIG. 2, cabinet 10 is divided generally into an upper compartment 22 and a lower compartment 24 by means of shelf 26. Cabinet 10 further includes base member 28. Shelf 26 and base member 28 are preferably constructed of either painted or galvanized sheet steel. Shelf 26 and base member 28 provide cabinet 10 with structural rigidity and may be secured to the side panels as with screws 30 or equivalent fasteners. Top member 20 also provides cabinet 10 with structural rigidity and may be secured to side panels 14 and 16 with screws 32. Front panel 12 is supported by side panels 14 and 16 so that it may be readily removed simply by removing screws or equivalent fasteners and lifting upwardly and outwardly.

As shown in FIG. 2, cabinet 10 houses an insulated evaporator/chiller 34, if desired, a hot water storage tank 36, if desired, and a fractional horsepower hermetic compressor 38 with static air condenser 40 to accompany the evaporator/chiller 34.

Figure 6:
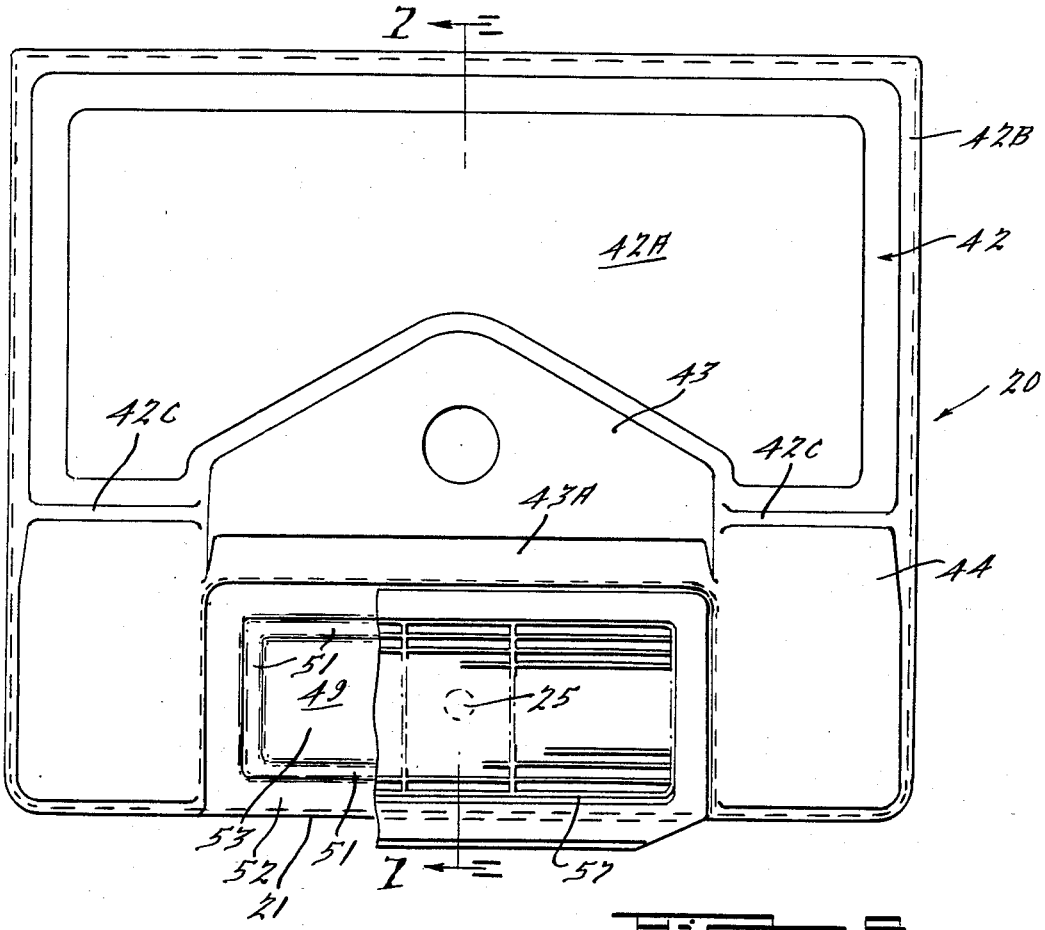
FIG. 6 is a top plan view of the invention with dispensing valve and gooseneck omitted, illustrating the tiered top member and waste water collection pan.
Figure 7:
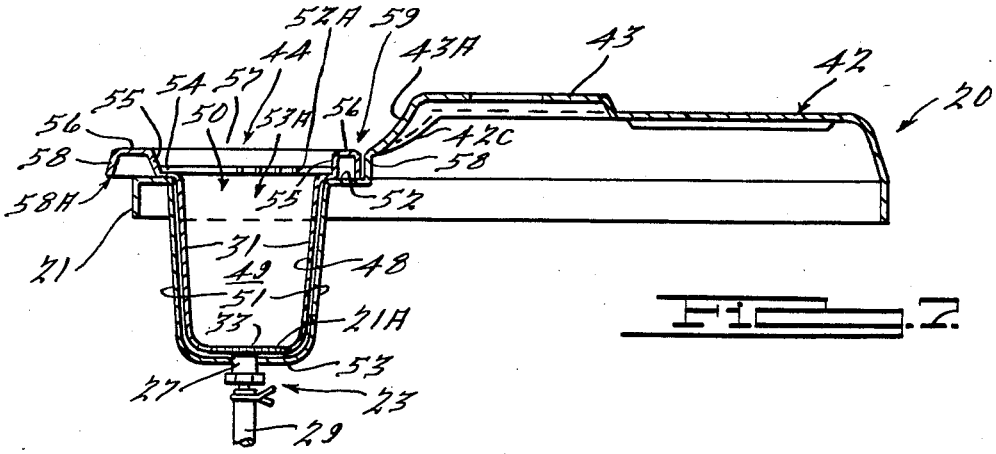
FIG. 7 is a cross-sectional view of the tiered top member and waste water collection pan showing retrofitting for connection to water removal plumbing taken along the line 7—7 of FIG. 6.

Referring to FIGS. 6 and 7 with continued reference to FIG. 1, top member 20 is contoured to include a pair of generally horizontal upwardly facing surfaces or tiers 42 and 44 disposed in stair-stepped relationship to one another. Surface 42 is elevated with respect to surface 44 and includes a recessed central region 42A substantially enclosed by a raised perimeter portion 42B to provide a resting surface for drinking cups or the like. A third generally horizontal upwardly facing surface or tier 43 located approximately in the center of top member 20 rises above surfaces 42 and 44 to provide the mounting surface for a gooseneck faucet 46. As shown in FIG. 1, the gooseneck faucet 46 has a nozzle 47 at the end thereof located generally above tiered surface 44.

Tiered surface 43 has a concavely downwardly sloping contour 43A which connects with surface 44. Similarly, surface 42 includes concavely downwardly sloping contours 42C which join with surface 44 on either side of contour 43A. These contours 43A and 42C allow any spilled water to run off to the lower tier 44.

Tiered surface 44 further includes a rectangularly shaped downwardly depending recess 52 located directly in front of contour 43A so that any runoff water from contour 43A will spill directly into recess 52. Any runoff water from concours 42C may be quite readily mopped or sponged into recess 52. Recess 52 extends to the front edge 21 of top member 20 to provide easy access to the drain cup or pan as will be discussed below.

A downwardly depending rectangular well 49 is formed in surface 44, generally centrally disposed within recess 52. Well 49 defines a rectangular opening 50 through top 20 at surface 44 and includes sidewalls 51 and a bottom wall 53. Recess 52 thus defines a ledge around the perimeter of well 49.

A readily removable waste water receptacle pan or cup 48 is nested within well 49 generally beneath nozzle 47 so as to catch any drips or spills which may occur when water is being drawn from faucet 46. Receptacle cup 48 may be molded from high impact plastic or the like and is sized to slide freely into and out of well 49 without interference. Receptacle cup 48 includes sidewalls 31 and a bottom wall 33 which are similar in shape and disposition to the sidewalls and bottom wall of well 49. The rim 52A disposed about the open end 53A of receptacle cup 48 has an outwardly extending, horizontally disposed annular flange or lip 54 which rests on the ledge formed by recess 52 when the cup is nested in place. An upturned, generally vertically disposed flange 55 is formed at the outer extremity of lip 54 to which a second outwardly extending, horizontally disposed flange 56 is attached. Vertical flange 55 is of sufficient length such that the horizontal lip 56 is generally flush with surface 44 when the receptacle cup 48 is in place. A removable grate 57 rests on lip 54 and is held in place by the vertical flange 55. Grate 57 thus covers opening 53A to prevent chewing gum, cigarette butts, and other debris from being discarded in the cup. A downturned, generally vertically disposed flange 58 is formed at the outermost extremity of flange 56 to provide the cup with a finished appearance. Flange 58 is formed or cut off at the appropriate length so that it will contact recess surface 52 to help support the cup. In addition, that portion of flange 58 which faces front edge 21 of top member 20 is exposed or beyond recess 52. The exposed part 58A of flange 58 enables cup 48 to be grasped and lifted out of well 49 for emptying or cleaning.

When the water cooler or fountain of the present invention is used without connection to a waste water removal system, cup 48 forms a water containing vessel without perforations in the bottom 33 thereof. Likewise, the bottom 53 of well 49 is also imperforate so that well 49 may also serve as a waste water receptacle. Thus, cup 48 and well 49 form nested waste water receptacles, the outer receptacle (well 49) catching whatever water is not caught by the inner receptacle (cup 48). With reference to FIG. 7 it will be seen, for example, that a certain amount of spillage may run down contours 43A and 42C and drain into well 49 by passing into recess 52, as at 59. Such seepage is usually slight, however, and may be mopped or sponged from well 49 or left to evaporate.

When it is desired to retrofit the water cooler or fountain of the invention for connection to waste water removal plumbing, the imperforate cup 48 is removed and replaced with a cup having perforations (21A) in bottom 33. An opening can be punched in bottom 53 of well 49 and preferably a circular area 25 is embossed in bottom 53 to identify most convenient location for punching. FIG. 6 shows well 49 with embossed circular area 25 still in place and an imperforate cup for drainless operation, while FIG. 7 shows a retrofitted embodiment with perforate cup and embossed area 25 punched out for connection to a waste water removal syste. With reference to FIG. 7, the opening 23 is fitted with threaded fitting, such as self-tapping fitting 27 and a flexible drain line 29 is connected thereto. Drain line 29 may be led through compartment 22 out through the back of the cabinet for emptying into an S-trap drain, or the like. Because the receptacle, trap and well are disposed within the upper interior of the cabinet this drain line 29 is completely concealed from view and the receptacle cup is self draining, by gravity feed, even into waste removal drains or S-traps disposed well above the floor.

Figure 3:
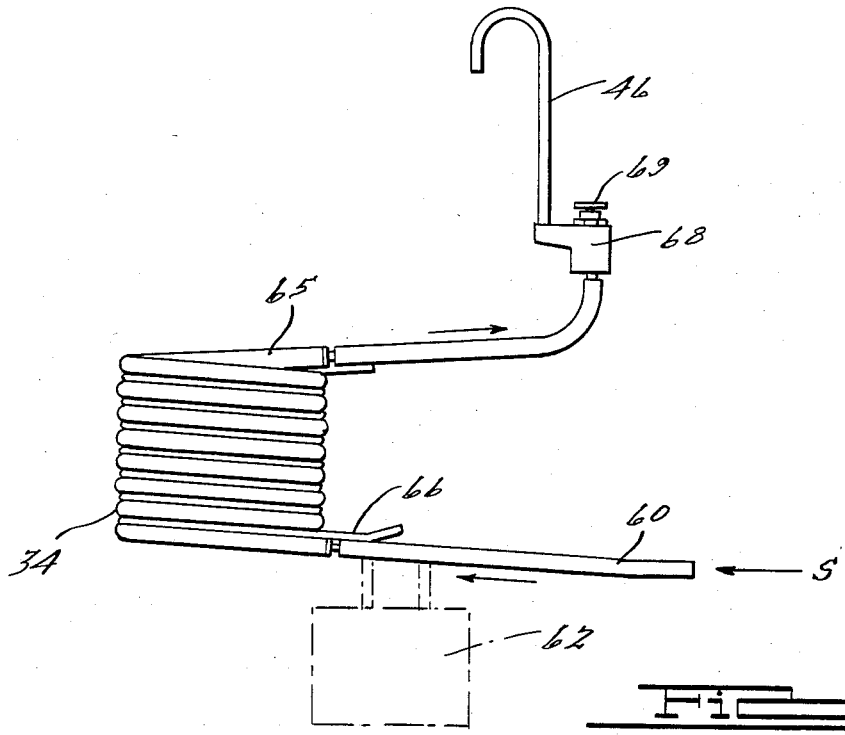
FIG. 3 is a schematic flow diagram illustrating a cold water embodiment of the present invention.
Figure 4:
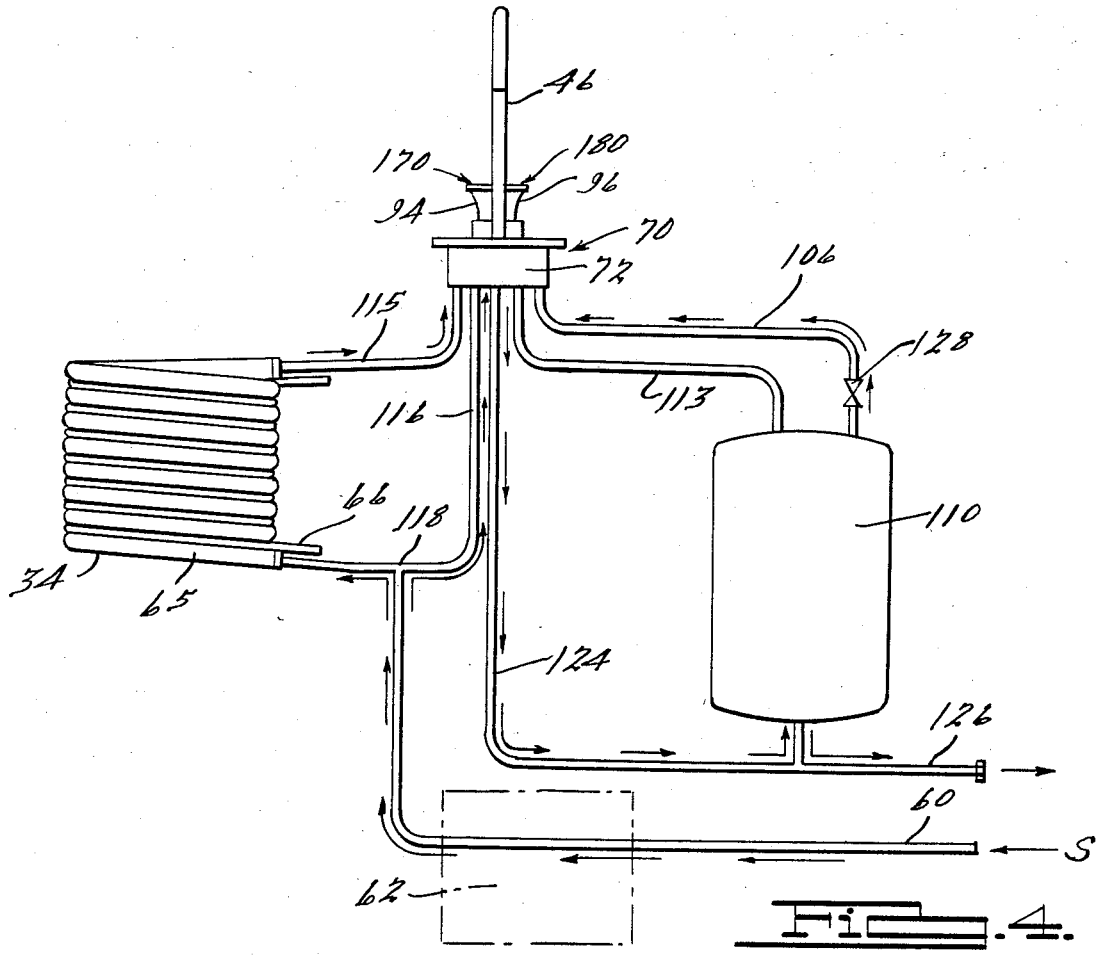
FIG. 4 is a schematic flow diagram illustrating a hot and cold embodiment of the present invention.
Figure 9:
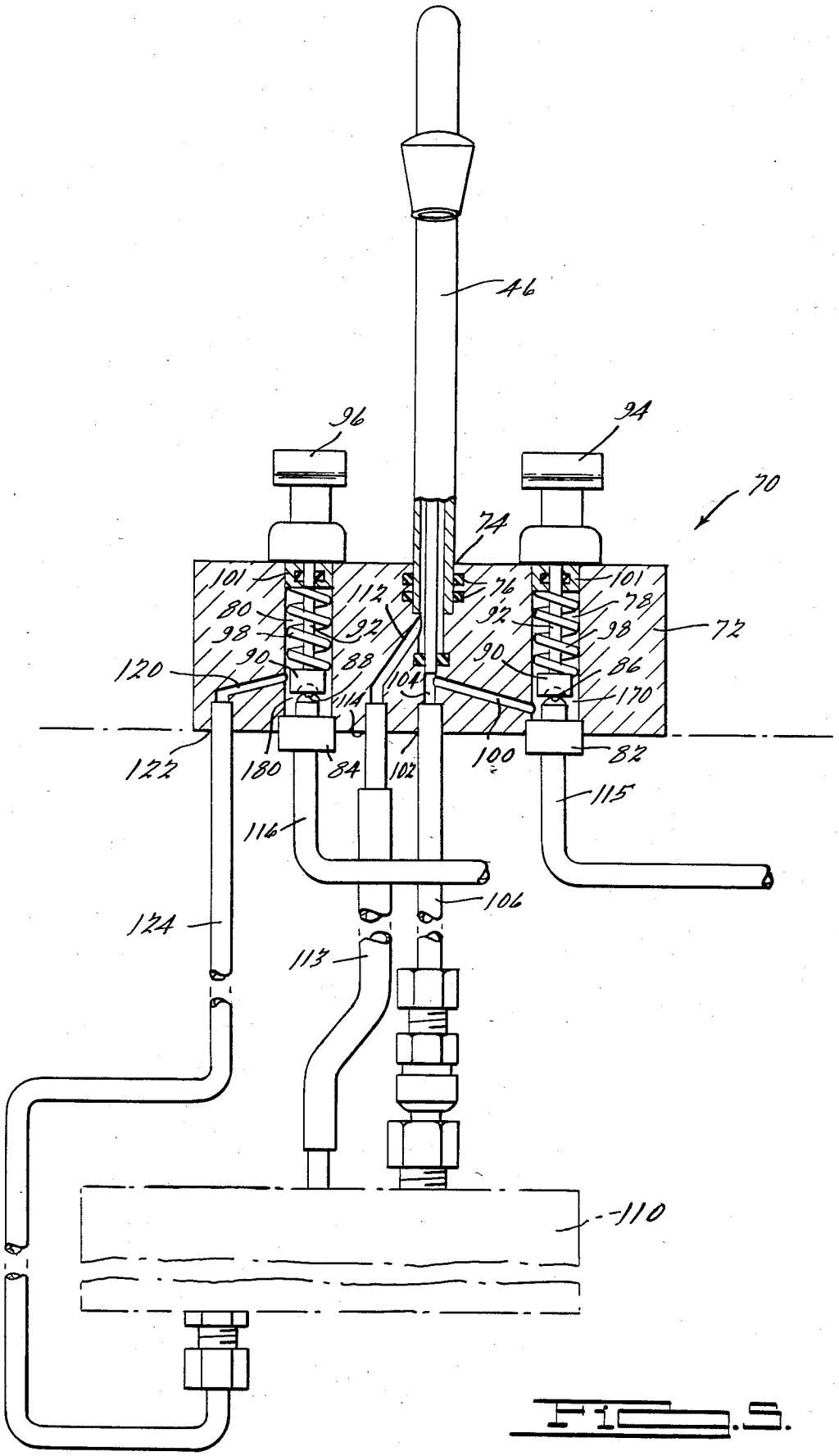

Referring now to FIGS. 3, 4 and 5 the fluid circuit or circuits of the invention will be described. It will be understood that the invention may be implemented in various embodiments, including a cold or chilled water dispensing embodiment (one temperature) and a hot and cold or chilled water dispensing embodiment (two temperatures). FIG. 3 diagramatically depicts the fluid circuit for a single temperature, cold water embodiment of the invention, while FIG. 4 diagramatically depicts a two temperature, hot water and cold water embodiment. FIG. 5 shows the faucet and valve arrangement of the hot water and cold water embodiment in greater detail. The valve arrangement for the cold water embodiment may be readily adapted from the valve arrangement shown in FIG. 5.

Referring now to FIG. 3, the fluid circuit of the cold water embodiment will be traced commencing with supply water pipe 60 which, in use, is coupled to a source of potable water designated schematically by reference character S. If desired, the inlet water from source S may be processed through optional water conditioner 62, as shown in broken lines in FIG. 3. Next the inlet water is passed through evaporator/chiller coil 34. Evaporator/chiller 34 includes a water coil 65 and refrigerant coil 66 in thermal communication therewith. The water coil 65 stores a quantity of chilled water for delivery through faucet 46 upon demand. Refrigerant coil 66 is coupled, in the usual fashion, to a refrigeration system including hermetic compressor 38 with static air condenser 40 and thermostat 41 (shown in FIG. 2). When the actuator arm or lever 69 of valve 68 on faucet 46 is actuated, potable water under supply or line pressure is forced through pipe 60 into coil 65 of evaporator/chiller 34. This in turn displaces chilled water stored in chiller 34 out through faucet 46. While the cold water embodiment has been illustrated to include a chiller, it will be understood that that invention is equally applicable to a fountain without a chiller for dispensing water at supply or line temperature.

FIG. 4 depicts the hot and cold embodiment of the invention, which includes inlet water pipe 60 for coupling to a pressurized source of potable water S, optional water conditioner 62, and optional chiller-/evaporator 34 having water coil 65 and refrigerant coil 66 as discussed above in connection with FIG. 3. A dual action valve 70, shown in more detail in FIG. 5, includes a valve body 72 having a generally centrally disposed recessed fitting 74 for attaching gooseneck faucet 46. O-rings 76 are provided to provide a fluid seal. The dual action valve 70 includes first valve bore 78 and second valve bore 80 for housing the cold valve 170 and hot valve 180, respectively. Bores 78 and 80 are terminated with fittings 82 and 84, respectively. The fittings 82 and 84 are coupled to inlet pipes 115 and 116, respectively and each include inlet orifice passages 86 and 88, respectively, which communicate with bores 78 and 80, respectively. Each bore houses a valve seat 90 which is coupled through linkage 92 to levers 94 and 96. Each valve is provided with a compression spring 98 mounted between the valve seat and end plugs 101 which compress the valve seats 90 against fittings 82 and 84 to provide a fluid seal. When the corresponding lever is depressed, the valve seat is lifted under spring tension away from the fitting permitting fluid flow through corresponding passages 86 or 88 into the bore chamber. Valve seats and valves are preferably metal and may be machined to form a fluid tight seal which is impervious to bacterial contamination or fungus growth. Due to the strength of the metal to metal construction, the valve orifices 86 and 88 may be relatively small (0.13 inches in diameter) as compared with prior art plastic to rubber valves (0.38 inches in diameter nominally). This greatly reduces the area of the valve orifice and results in a significant pressure drop below line pressure. Accordingly, the valve is far less apt to leak than prior art large diameter valves.

The cold water valve 170 communicates with gooseneck 46 through a passageway 100 formed in valve body 72. Gooseneck 46 is also in fluid communication with inlet fitting 102 by means of a passageway 104 within valve body 72. Fitting 102 is receptive of hot water via pipe 106 from a hot water tank 110, as will be discussed below. Gooseneck 46 is also in fluid communication with passageway 112 which communicates through fitting 114 to vent tube 113. Vent tube 113 communicates with tank 110, as shown in FIG. 4. Fitting 84 of hot water valve 180 is coupled through pipe 116 to the pressurized source of potable water S through tee fitting 118. The hot water valve 180 includes a passageway 120 within valve body 72 which communicates with bore 80. Passageway 120 is coupled through fitting 122 to pipe 124 which connects to the underside of hot water tank 110 and also communicates with drain pipe 126.

In operation, when lever 94 of the cold water valve 170 is depressed, water flows under pressure through inlet pipe 115 from chiller 34, into bore 78, and then through passageway 100 and out through gooseneck 46. At the same time, inlet water from source S flows through pipe 60 and into coil 65 of chiller unit 34 to replenish the chilled water discharged therefrom. When lever 96 of the hot water valve 180 is depressed, water flows under pressure from source S through pipe 60, tee fitting 118, and pipe 116 into valve bore 80. It then flows, under pressure, through passageway 120 and into pipe 124 to the underside of hot water tank 110. The charge of water delivered to the underside of tank 110 increases the pressure within tank 110, forcing hot water out through the top of the tank, through check valve 128 and then through pipe 106, passageway 104, and out through gooseneck 46.

The various embodiments which have been set forth above were for the purpose of illustration and were not intended to limit the invention. It will be appreciated by those skilled in the art that various changes and modifications may be made to these embodiments described in this specification without departing from the spirit and scope of the invention as defined by the appended claims.

I claim:

1. A drainless water fountain for connection to a pressurized source of potable water comprising:

a generally vertically arranged cabinet defining an internal compartment;

a top member disposed on said cabinet defining a first generally horizontal tier and a second generally horizontal tier above said first tier;

gooseneck means disposed on said second tier having discharge nozzle disposed substantially above said first tier;

a downwardly depending well integrally formed in said top member and disposed directly beneath said discharge nozzle; and waste water receptacle comprising downwardly depending fluid containment pan having an imperforate bottom and nestably carried in said well, said pan having an outwardly flanged rim for resting on said top member, said rim having a top surface being substantially flush with the surface of said first tier and having an exposed flange portion substantially flush with the surface of said first tier and protruding forwardly of said cabinet to provide a means for grasping and removing said pan from said well.

2. The water fountain of claim 1 wherein said well has an imperforate bottom allowing said well to serve as a supplemental fluid containment receptacle.

3. The water fountain of claim 1 wherein said well defines generally vertical sidewalls and a bottom wall, and wherein said pan includes side walls and a bottom wall which are similar in shape and disposition to said sidewalls and bottom wall of said well.

4. The water fountain of claim 1 wherein said pan includes a first upturned and generally vertically disposed flange at the periphery of said pan;

a second outwardly extending, generally horizontally disposed flange connected to said first flange; and a downturned generally vertically disposed third flange formed at the outermost extremity of said second flange, said third flange providing a bearing surface for resting on said top member.

5. The water fountain of claim 4 wherein said well includes an integrally formed recessed periphery which defines a generally horizontal ledge around the periphery of said well, and wherein said third flange supports said pan by resting on said ledge.

6. The water fountain of claim 4 wherein said pan has a front edge and said second flange along said front edge overhangs said top member and said third flange along said front edge thereby defines said means for grasping to remove said pan from said well.

7. The water fountain of claim 4 wherein said waste water receptacle is provided with an embossed knockout means for retrofit connection to a drain.

* * * * *

UNITED STATES PATENT AND TRADEMARK OFFICE

CERTIFICATE OF CORRECTION

PATENT NO. : 4,600,148

DATED : July 15, 1986

INVENTOR(S) : Doyle Raymer

It is certified that error appears in the above-identified patent and that said Letters Patent is hereby corrected as shown below:

Abstract line 3 on title page, "multiply" should be --multiple--.

Column 4, line 16, "concours" should be --contours--.

Column 5, line 17, "syste" should be --system--.

Column 5, line 35, "diagramatically" should be --diagrammatically--.

Column 5, line 37, "diagramatically" should be --diagrammatically--.

Column 5, line 66, "that" , second occurrence, should be -- the --.

Column 8, line 31, "4" should be --1--.

Signed and Sealed this

Thirteenth Day of October, 1987

*Attest:*

*Attesting Officer*

DONALD J. QUIGG

*Commissioner of Patents and Trademarks*